United States Patent [19]

Mook

[11] Patent Number: 5,067,719

[45] Date of Patent: Nov. 26, 1991

[54] SPIN COMMUNICATING BALL

[76] Inventor: William H. Mook, 9124 Leith Dr., Dublin, Ohio 43017

[21] Appl. No.: 560,804

[22] Filed: Jul. 31, 1990

[51] Int. Cl.[5] ..... A63B 41/00; A63B 43/00; A63B 37/14

[52] U.S. Cl. ..... 273/213; 273/58 BA; 273/60 R; 273/61 R; 273/183 C; 40/327

[58] Field of Search ..... 273/183 C, 1.5 A, 213, 273/26 A, 29 A, 58 R, 58 K, 60 R, 60 R, 60 A, 61 R; 40/327

[56] References Cited

U.S. PATENT DOCUMENTS

| | | | |
|---|---|---|---|
| D. 27,441 | 7/1897 | Dunn | D21/205 |
| D. 55,413 | 6/1920 | Cigol | D21/205 |
| D. 194,688 | 2/1963 | Santora | D21/205 |
| 676,506 | 6/1901 | Knights et al. | 273/213 |
| 2,504,650 | 4/1950 | Chessrown | 40/327 X |
| 2,709,595 | 5/1955 | DeVries | 273/183 C |
| 4,546,975 | 10/1985 | Nims | 273/1.5 A |
| 4,796,888 | 1/1989 | Louez | 40/327 |

*Primary Examiner*—George J. Marlo

*Attorney, Agent, or Firm*—Watkins, Dunbar & Pollick

[57] ABSTRACT

This invention relates to a spin communicating ball. Communication is achieved by coloring various sections of the surface of the ball with different colors that mix and form new colors when the ball is spun. Preferably, the colored sections are three mutually perpendicular great circles and, preferably, the different colors are the primary colors, red, blue, and yellow. For a golfer, the intersections of the great circles can be used as a focus spot in hitting the ball. Individual great circles can be used to align the ball with the target and the golfer with the ball and also as an aide in putting.

6 Claims, 1 Drawing Sheet

SPIN COMMUNICATING BALL

BACKGROUND OF THE INVENTION

1. Field of the Invention

This invention relates to any game that uses a ball in which it is desirable to impart spin to the ball and have a visual indication of the spin on the ball. This invention is especially useful in the game of golf wherein this invention communicates to the golfer the magnitude and direction of the spin of the ball.

2. Description of the Prior Art

In the past, golf balls have been designed with markings that aid the golfer in either aligning himself and the ball in the proper direction or with markings to assist the golfer in hitting the golf ball at its center, the so called "sweet spot".

For example, U.S. Pat. No. 676,506 to Knight et al. depicts a golf ball with spots or markings which indicate to the golfer the point at which the club should strike the ball and upon which the eye is centered in making the shot. The ball may also have lines or stripes that are located on great circles to assist the golfer in properly aligning himself with respect to the direction in which the ball should travel.

U.S. Pat. No. 2,709,595 to DeVries discloses a practice putting ball with one great circle. The ball is aligned so that the stripe is in line with the intended direction of travel. If the ball is improperly hit due to a faulty swing, faulty aim or improper balance of the call, the ball will roll at an angle deviating from the stripe line, causing an illusion of the widening of the stripe. The greater the width of the stripe, the greater the magnitude of the error of the golfer in stroking the putt.

Design U.S. Pat. Nos. D55,413 to Cigol, D27,441 to Dunn and D194,688 to Santora illustrate various designs that have been used with golf balls or similar articles.

As is apparent from these references, it is important that a golfer properly align himself and the golf ball in the direction in which the golf ball is to be hit. It is equally important that the golfer hit the golf ball at its center, i.e., the "sweet spot". Generally if the alignment is proper and the golfer has hit the golf ball on the "sweet spot" the resulting shot will cause the golf ball to travel in the intended direction. When alignment is not correct and the golf club head does not hit the golf ball on the "sweet spot" in a line to the target, the ball is likely to travel in directions that do not take it toward the intended target. Often this misdirection is caused by the ball spinning and results in a hook, slice, top or underspin. In the past, the golfer has had only the flight of the ball to aid him or her in determining the spin that had been placed on the ball. Nowhere in the prior art is found in a single ball a unique marking system that allows the golfer to correctly align himself with the golf ball and the intended direction of flight, to hit the golf ball on the "sweet spot" as indicated by such markings, and then to observe the spin, if any, placed on the ball while it is in flight, or to observe an incorrect stroke when the ball has been putted.

SUMMARY OF THE INVENTION

The present invention solves all of these problems by providing a unique ball marking system that, when applied to golf balls, provides a means by which the golfer can align the ball and himself in the proper position with respect to the intended flight of the ball, the golfer can identify and concentrate on the "sweet spot" where the ball is to be struck, and after the ball is hit, to observe any spin imparted to the ball because of incorrect alignment or failure to hit the ball on the "sweet spot", in a line to the target. Further, this invention provides a golf ball that aids the golfer in putting in that it serves to provide the golfer with a means for aligning and hitting the ball and observing the results of an improper stroke due to a faulty swing, faulty aim, or improper balance of the ball.

In its basic form, this invention provides a spin communicating ball. Spin communication is defined as the ability to provide to the player a sense of the rotation of a ball while it is in motion. In its elementary form, spin communication is achieved by marking the surface of a ball with color markings of different colors that mix in various proportions to form a range of colors depending on the rate and direction of the spin of the ball. As a further refinement, the different surface colorings on the ball are applied as three stripes that are mutually perpendicular great circles of the ball. That is, the three stripes (three great circles) are each at right angles to each other. In addition, each stripe is a different color.

By applying stripes as great circles, not only do the colors mix depending on the rotation of the ball, but they also serve as aligning devices and as an identification, at the point where the great circles intersect, of the point at which the ball is to be stroked, i.e., the "sweet spot".

More particularly, the plane formed by a first great circle is generally parallel to the surface of the playing field. A second great circle, perpendicular to the first or level great circle is aligned so as to be at right angles to a line to the target. And finally, the third great circle is perpendicular to the first and second great circles and is in a plane that includes the line to the target. The intersection of the first great circle (level to the ground) and the third great circle (pointing to the target) identifies the "sweet spot" where the club head should strike the ball. The intersection of the second great circle (perpendicular to the target) and third great circle (pointing to the target) identifies the center of the ball where the golfer's attention should be focused when hitting the ball.

The best color communication is obtained when each of the three great circles is of a different primary color. That is, where each of the three great circles is red, blue, and yellow, respectively. In order to obtain the greatest color mixing, it is desirable to avoid the overlap of the stripes on the golf ball. As such, the great circle stripes are formed in four segments that are pointed at each end so as to avoid color overlap at the point of intersection.

Clearly, the communication of spin is of advantage in many sports, e.g., tennis, table tennis, volleyball, baseball and similar type activities where it is desirable to put a spin on the ball. In such sports, spin communication is especially effective at the time of serving, pitching or otherwise delivering the ball since the user can gain an appreciation of the imparted spin with reference to the starting position of the ball. Even when the ball is in play, a change in color imparts to the user the fact that the user has used a stroke that has been effective in altering the spin of the ball.

In a sport such as golf, where the ball may be aligned prior to each stroke, spin communication tells the golfer whether the ball has been given top spin or has been sliced or hooked. Moreover, when colored great circle stripes are used they can also serve as an aid to the golfer in aligning the ball so that it travels toward the target and their intersection provides a spot on the ball where the golfer may focus his attention so as to hit the ball squarely. In putting, movement of a single great circle tells the golfer whether the ball has been stroked correctly.

The foregoing and other advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 1:
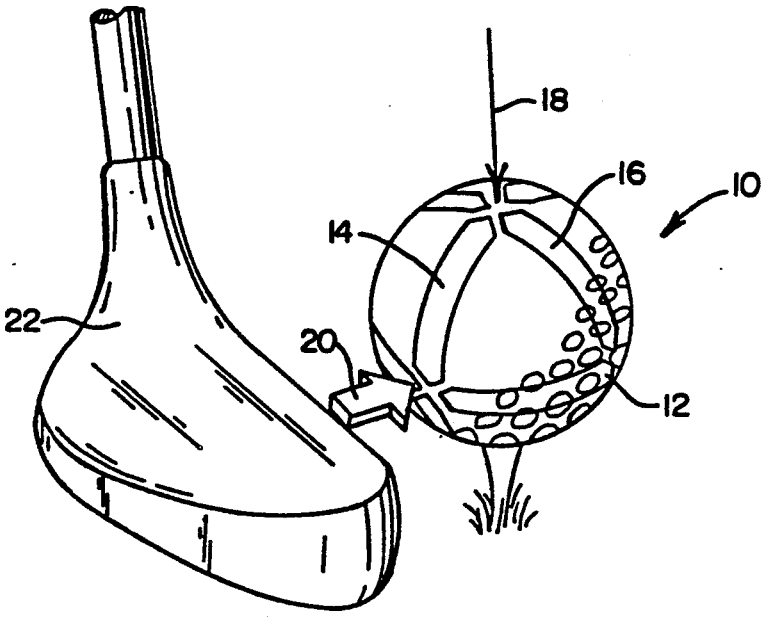
FIG. 1 is a perspective view showing the position of a golf ball according to this invention with respect to a club head when teeing off.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalence thereof.

DETAILED DESCRIPTION OF THE INVENTION AND BEST MODE FOR CARRYING OUT THE PREFERRED EMBODIMENT

FIG. 1 shows a golf ball 10 according to this invention as it might be used by a golfer when teeing off. The golf ball 10 is a conventional white golf ball with three stripes that form mutually perpendicular great circles around the golf ball 10. A first (equatorial) great circle 12 is colored yellow and is place so as to be parallel to the playing surface. A second (polar) great circle 14 is colored red and is perpendicular to the yellow equatorial great circle 12. The red equatorial circle 14 is in a plane that includes a line to the target that should also coincide with the path of the club head 22 through the ball 10. The third great circle 16 is blue in color and is perpendicular both to the yellow great circle 12 and the red great circle 14. The face of the club 22 should be parallel to the plane containing the blue great circle 16.

Generally it is recognized that many golf problems stem from the fact that the golfer and the club head are not square (at right angles) to the target line. Normally, the toes, knees, hips, and shoulders should be parallel to the target line, that is, the line included in the plane of the red great circle 14. The center of the club face should be perpendicular and centered on the target line passing through the red great circle 14 at the point where it intersects the yellow (equatorial) great circle 12. Alternatively, the face of the club 22 should be parallel with the plane that includes the blue polar great circle 6.

The two polar great circles, that is, red polar great circle 14 and blue polar great circle 16 intersect at a point on the top of the ball where the golfer can focus his attention in hitting the ball. This "center of attention" is denoted by the arrow 18 in FIG. 1. Furthermore, the intersection of the yellow great circle 12 and the red great circle 14 defines the "sweet spot", that is, that point at which the center of the face of the club should make contact with the ball as indicated by arrow 22.

As noted in the Figures, each of the great circles 12, 14, and 16 are each formed from four sectors. These sectors are pointed at each end where they intersect with another great circle to that they do not overlap at the point of intersection thus avoiding unwanted color mixing.

It is possible simply to form three great intersecting circles of overlapping color. It is also possible to color the surface of the ball in various sections with different colors in ways other than that which is shown so as to produce color mixing when the ball is spun. Moreover, it is possible to use other colors than the primary colors. However, that which is shown is preferred and felt to provide the greatest degree of difference among the various colors that can be obtained as a result of a spinning ball as well as serving as an attention focussing and alignment means.

Figure 2:
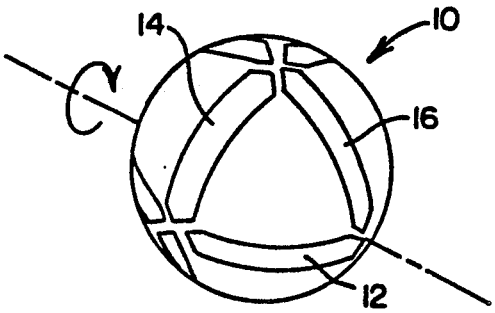
FIG. 2 is a perspective view showing the rotation of the ball when it is struck so as to produce top spin.

FIG. 2 illustrates the direction of spin when the ball is struck so as to produce top spin. It has been assumed that the ball as shown FIG. 2 was aligned with reference to the target as was described in conjunction with the above description for FIG. 1. When the ball as been hit so as to produce top spin, the yellow equatorial great circle 12 and the blue polar great circle 16 merge to give a green coloration to the ball while it is in flight. The degree of color saturation observed is dependant on the width of the great circles.

Figure 3:
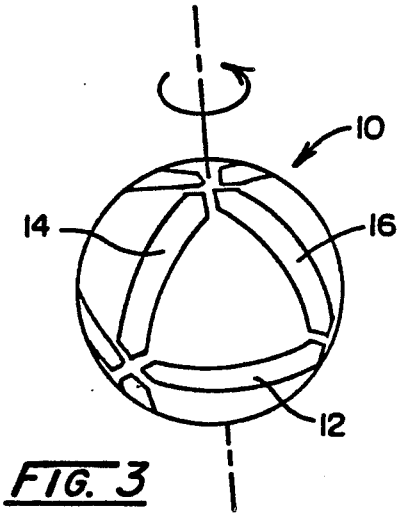
FIG. 3 is a perspective view of the ball of this invention showing the spin of the ball when it is struck so that side spin results.

FIG. 3 illustrates the side spin that results when the ball is struck so as to hook or slice. When side spin is produced, the red line 14 and blue line 16 merge to give a purple coloration to the ball in flight.

Figure 4:
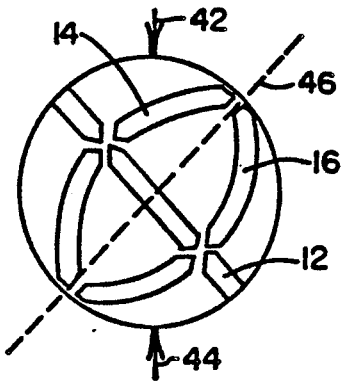
FIG. 4 is a perspective view of the ball showing the spin axis rotated 45° away from any of the three node axes.
Figure 5:
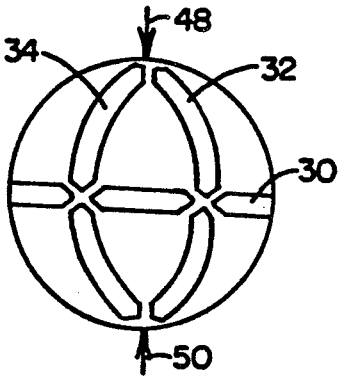
FIG. 5 is a perspective view showing the spin axis in alignment with a node axis.

FIGS. 4 and 5 illustrate the result of striking the ball in such a way so as to produce spinning at angles between a pure top spin and a pure side spin. In such an instance, different coloration results for each angle of spin. To further illustrate this, it should be recognized that any color can be formed by mixing three primary colors in differing proportions. When using inks, the three primary colors are red, yellow and blue. The process of making colors is known as subtractive color formation because inks subtract colors from white light to form a resulting color. The three, primary colored, mutually perpendicular, great circles of this invention form six nodes at the points where they intersect. If all three primary colors mix equally the ball looks a purplish-brown. As shown in FIG. 4, this occurs whenever the spin axis is rotated 45° from any of the three node axes. The spin axis is denoted by the arrows 42 and 44. One of the node axes is denoted by the dotted line 46 in FIG. 4. The colors of the great circles are as has been previously described.

As shown in FIG. 5, when a node axis (indicated by arrows 48 and 50) lines up with the spin axis, one of the great circles 30 forms an equator around the ball. The equator does not mix with the other two colors. If the node axis is perfectly lined up with the spin axis, the two remaining colors 32 and 34 mix equally. If the node axis is formed from the intersection of the blue and yellow great circles, the ball appears green with a red equator. If great circles 32 and 34 are red and yellow then the ball takes on an orange color with a blue equator. If the great circles 32 and 34 are red and blue, then the ball takes on a purple color with a yellow equator 30. When the angle between the spin axis and any of the node axis is between 0° and 45°, the equatorial band starts to mix with the colors of the other two great circles 32 and 34. Depending on the angle, the ratio of colors between the equatorial band and the polar bands change resulting in a change in color of the ball.

The angle between the node axis and spin axis is usually stable due to gyroscopic forces. However, in an unbalanced ball, or in a ball subjected to cross winds, this angle can vary in flight, thus effecting the color. Rapid random fluxuations in spin angle can cause the ball to look more brown. Since geometrically distinct color zones are formed on the ball in flight, what the golfer sees also depends on the side of the spinning ball he sees. If a pole is tilted away or towards a golfer, apparent color can be effected accordingly.

Finally, many angles of spin can produce equivalent colorings. However, the trajectory of the ball will not be equivalent in these cases. By combining trajectory and color information, a golfer can form an opinion of precisely what the ball is doing in flight to produce the observed coloration.

As noted in U.S. Pat. No. 2,709,595, which is herein incorporated by reference, one of the great circles on a ball of this invention can one used to determine whether a putted ball has been improperly stroked because of a faulty swing, faulty aim, or improper balance. When such a fault is present, the ball will roll at an angle causing an illusion of the widening of the stripe. When one of the great circles is aligned with the target line, the width of the stripe increases in an amount corresponding to the angle of deviation from the target line. Accordingly, the apparent width of the stripe in a putting situation is an index of the magnitude of the error of the golfer.

It is possible that changes in configurations to other than those shown could be used but that which is shown is preferred and typical.

It is therefore understood that although the present invention has been specifically disclosed with the preferred embodiment and examples, modifications to the design concerning sizing and shape may be apparent to those skilled in the art and such modifications and variations are considered to be within the scope of the invention and the appended claims.

What is claimed is:

1. A spin communicating ball comprising a ball having on the surface thereof color markings comprising three stripes forming three great circles on said ball with each said stripe being at right angles to the other two stripes and each said stripe being of a different primary color, said different primary colors mixing in various proportions to form a range of colors depending on the direction of spin of said ball.

2. A spin communicating ball according to claim 1 wherein a first of said three great circles is colored yellow, a second of said three great circles is colored blue, and a third of said three great circles is colored red.

3. A spin communicating ball according to claim 1 wherein each said stripe is pointed in an area of intersection with another stripe so that said stripes do not overlap in said area of intersection.

4. A spin communicating ball according to claim 1 wherein said ball is a golf ball.

5. A spin communicating golf ball according to claim 4 wherein a firs of said three great circles is colored yellow, a second of said three great circles is colored blue, and a third of said three great circles is colored red.

6. A spin communicating golf ball according to claim 4 wherein each said stripe is pointed in an area of intersection with another stripe so that said stripes do not overlap in the area of intersection.

* * * * *